United States Patent [19]

Perrine

[11] Patent Number: 4,467,698

[45] Date of Patent: Aug. 28, 1984

[54] ANGULAR SHAPE FIRING PIN FOR USE WITH A COLLAPSIBLE TOGGLE RECOIL IN A HAND HELD WEAPON

[76] Inventor: Walter E. Perrine, 15050 Burbank Blvd., Apt. No. 17, Van Nuys, Calif. 91411

[21] Appl. No.: 321,736

[22] Filed: Nov. 16, 1981

[51] Int. Cl.[3] ..... F41C 5/00

[52] U.S. Cl. ..... 89/190; 42/25

[58] Field of Search ..... 42/25; 89/168, 176, 89/190

[56] References Cited

U.S. PATENT DOCUMENTS

| | | | |
|---|---|---|---|
| 903,998 | 11/1908 | Mauser | 42/25 |
| 3,630,119 | 12/1971 | Perrine | 89/189 |
| 3,661,049 | 5/1972 | Perrine | 89/189 |
| 3,709,911 | 1/1973 | Perrine | 89/189 |
| 3,732,779 | 5/1973 | Perrine | 89/189 |
| 3,748,961 | 7/1973 | Perrine | 89/189 |
| 3,783,739 | 1/1974 | Perrine | 89/189 |
| 4,126,079 | 11/1978 | Perrine | 89/190 |
| 4,183,282 | 1/1980 | Perrine | 89/189 |

FOREIGN PATENT DOCUMENTS

| | | | |
|---|---|---|---|
| 18363 | of 1910 | United Kingdom | 89/190 |

*Primary Examiner*—Stephen C. Bentley

*Attorney, Agent, or Firm*—Warren F. B. Lindsley

[57] ABSTRACT

Hand held rifles and pistols employing a novel bolt firing pin configuration and controls therefor which effectively absorb the effects of the shell explosive forces.

5 Claims, 19 Drawing Figures

10B
63
88
62
61
73
44
42
43

92
15
10
10A
10B
51
60
74
75

FIG. 15
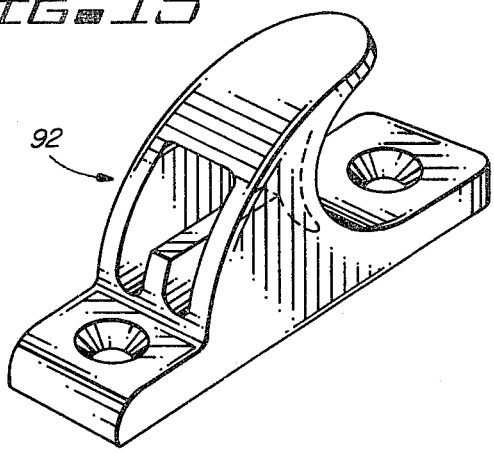
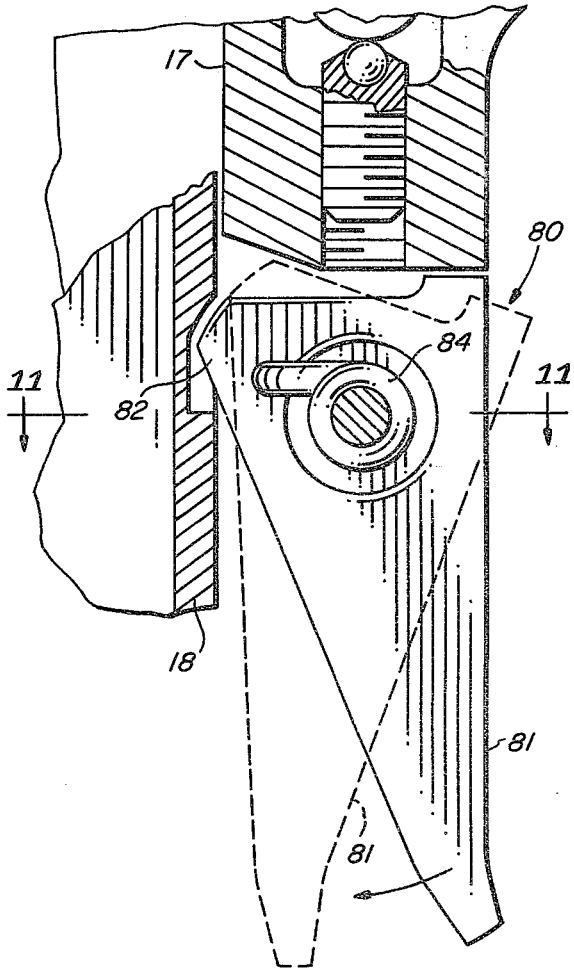
FIG. 10
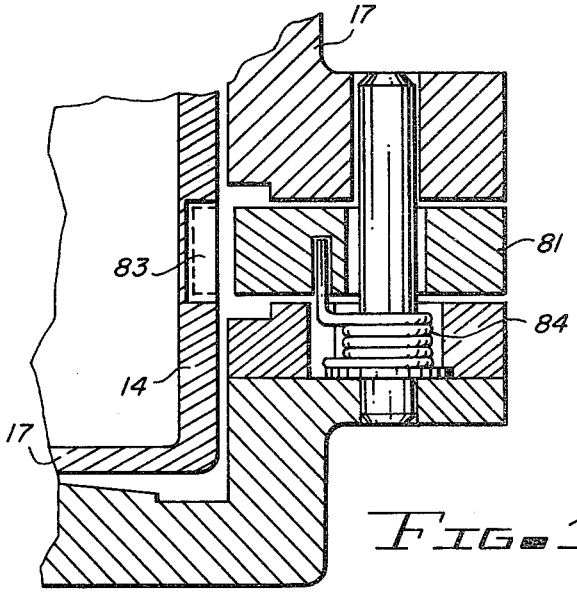
FIG. 11
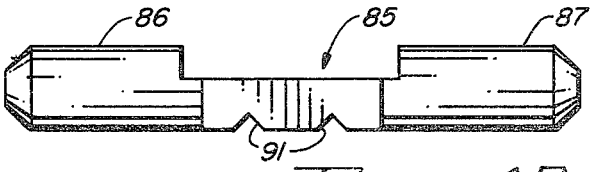
FIG. 13
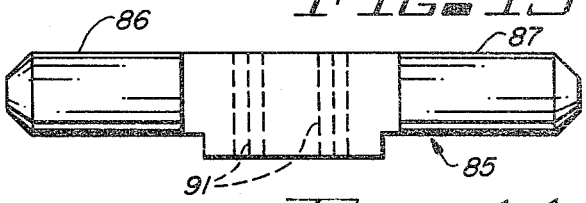
FIG. 14
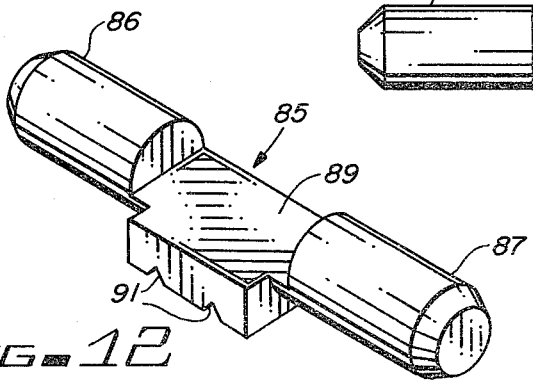
FIG. 12

ANGULAR SHAPE FIRING PIN FOR USE WITH A COLLAPSIBLE TOGGLE RECOIL IN A HAND HELD WEAPON

BACKGROUND OF THE INVENTION

This invention relates to weapons and, more particularly, to an angular firing pin or lever which cooperates with a collapsible toggle recoil system for releasing the spent shell and absorbing the recoil forces of a hand gun.

1. Field of the Invention

This invention is particularly directed to weapons such as rifles and pistols wherein a novel bolt extending means is tripped from a locked position when the gun is fired, aids in releasing and ejecting the spent shell and is configured to substantially reduce the weight of the moving parts of the weapon to reduce recoil of the weapon system.

2. Description of the Prior Art

Heretofore, the majority of all weapons of this class have been toggle actuated causing their toggle links to recede into the handle of the gun when fired to offset the effects of firing recoil and are biased toward their locked position by a spring means bearing in a given area on the toggle.

Applicant's U.S. Pat. Nos. 3,630,119; 3,661,049; 3,709,091; 3,732,779; 3,748,961; 3,783,739 and 4,126,079 and 4,183,282 are the closest prior art known but differ from the invention claimed herein.

Since the largest contributor to the forces of recoil in toggle action weapons are the moving parts of the weapon arranged above the hands of the user, it is necessary to reduce this weight if recoil of the weapon is to be further reduced and more effectively controlled. Accordingly, the bolt design of the prior art and its spring control means arranged above the trigger hand of the user must be modified or changed.

SUMMARY OF THE INVENTION

In accordance with the invention claimed, a new and improved mechanism employing a novel bolt firing pin configuration and controls therefor is disclosed which can be used effectively to absorb the effects of the shell explosive forces in weapons such as rifles and pistols.

The new and improved weapons employing such a mechanism utilize gun barrel pressure to drive their bolts and associated mechanism from their at rest positions to their tripped positions. At the time this happens, the bullet has left the barrel of the gun and the residual pressure in the gun causes the bolt and its controlling mechanism to move to their fully retracted positions in the handle of the weapons. Recoil springs in the gun reacting on the bolt return the bolt to a predetermined position for locking in place.

It is, therefore, one object of this invention to provide a new and improved hand held weapon in which gas pressure generated in a gun barrel causes the bolt controlling gun mechanism to recede to a retracted position in the handle of the weapon.

Another object of this invention is to provide an improved weapon in which biasing forces acting on the firing pin aid in absorbing recoil.

A still further object of this invention is to provide an improved weapon in which the bolt upon release is free of the drag of any recoil restraints.

A still further object of this invention is to provide an improved weapon in which the bolt is held in weapon firing position and released by a single link retracting into the handle of the weapon.

A still further object of this invention is to provide an improved weapon employing a link, the contour of which cooperates with a part of the bolt to provide a means for guiding it into the handle of the weapon.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which:

FIG. 10 is an enlarged view partially in section of the clip release mechanism shown in FIG. 1;

FIG. 11 is a cross-sectional view of FIG. 10 taken along the line 11—11;

FIG. 12 is a perspective view of the safety catch used in the triggering mechanism of the weapon shown in FIG. 1;

FIG. 13 is a front view of the safety catch shown in FIG. 12;

FIG. 14 is a top view of the safety catch shown in FIG. 13;

FIG. 15 is a perspective view of the front sight of the weapon shown in FIG. 7;

DESCRIPTION OF THE PREFERRED EMBODIMENT

Figure 1:
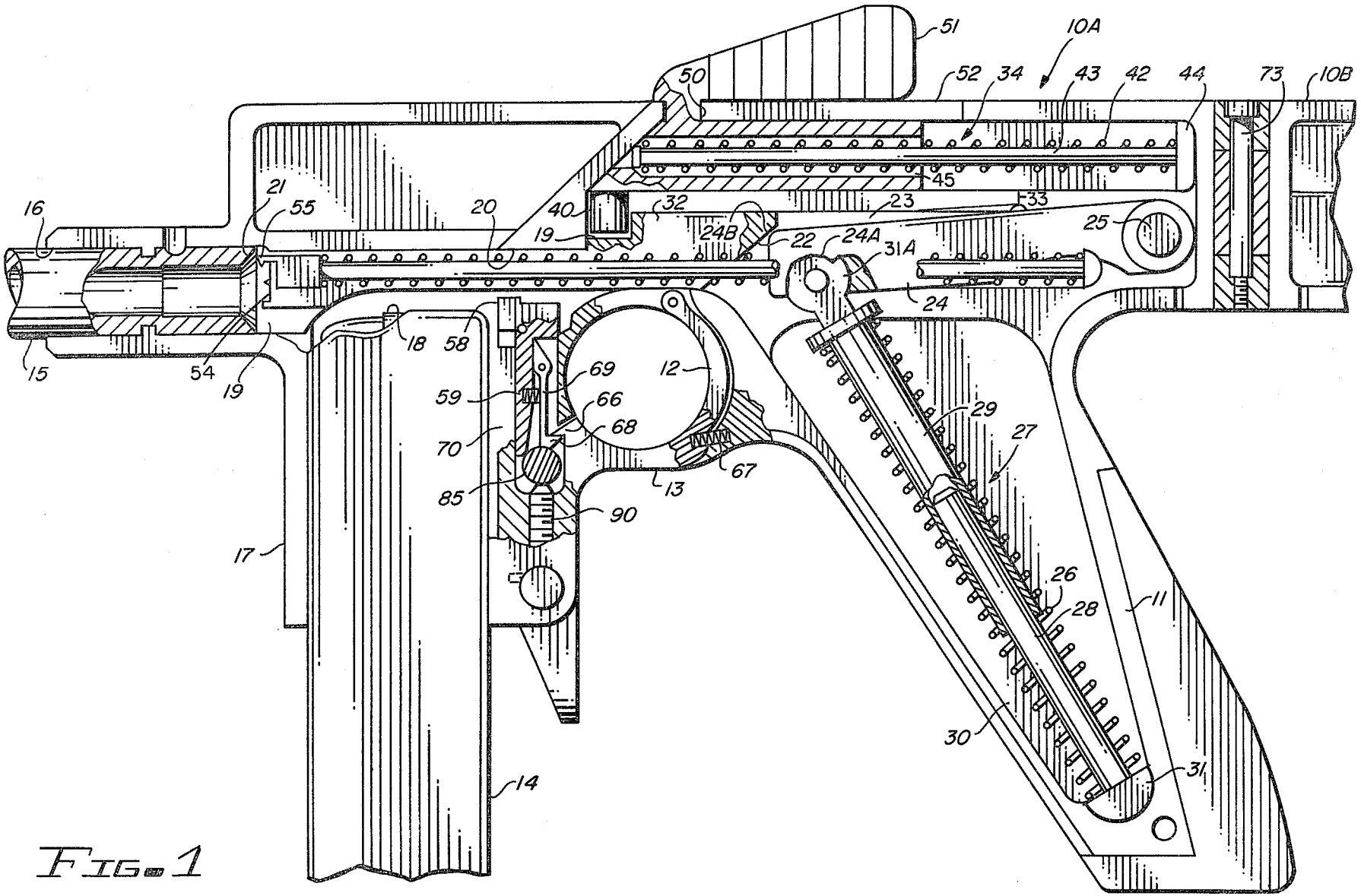
FIG. 1 is a partial cross-sectional view of a gas operated weapon with its link operating mechanism in position during a gun firing operation and embodying the invention.
Figures 5, 6:
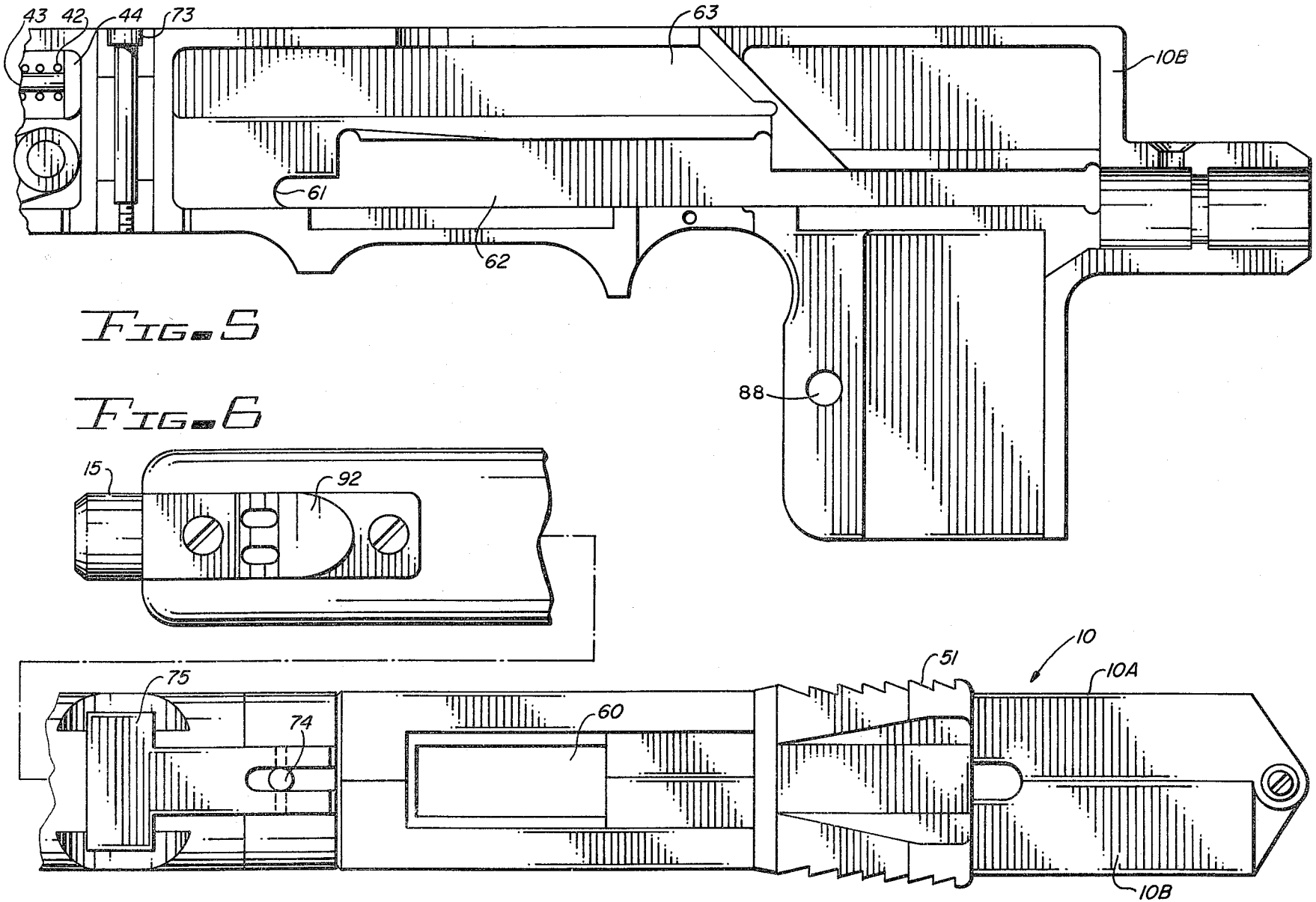
FIG. 5 is a cross-sectional view of the other mating half of the frame of the weapon shown in FIG. 1 reversed 180 degrees.
FIG. 6 is an exploded top view of the gas operated weapon shown in FIG. 1.

Referring more particularly to the drawings by characters of reference, FIG. 1 shows an example of one embodiment of this invention illustrating a partial view of a pistol having a frame 10, handle 11, trigger 12 with trigger guard 13 and a bullet magazine 14. A demountable adjustably positioned barrel 15 is received in a bore 16 in the front end of frame 10 comprising two substantially identical juxtapositioned parts 10A and 10B shown in FIGS. 1, 2 and 5.

The bullet magazine 14 is demountably secured by a releasable latch shown in FIGS. 10 and 11 in a guide sleeve 17 of frame 10 to feed the bullets 18 into insertion and firing position by a bolt 19 which moves on guiding surfaces 20 in frame 10 into an aligning aperture 21 in the rear end of barrel 15. The rear end of bolt 19 is provided with an angular surface 22 serving as a cam rider mounted for rotation over a cam surface 23 of a link 24 pivotally connected by pin 25 to frame 10 of the weapon. Normally, when bullet 18 has been loaded in the barrel in firing position, link 24 is aligned, as shown in FIG. 1, at which time the longitudinal axis of link 24 is at an angle slightly below a line between the center of surface 22 and pin 25.

A compression spring 26 carried on a telescoping push rod 27 comprising two tubular parts 28 and 29 is slidingly supported in a clearance hole 30 in handle 11 of the weapon. A dome shaped head 31A is provided at the free end of part 29 of rod 27 to bear against the free end of link 24 in a groove 24A or indentation having a curvature similar to the engaging part of head 31A, as shown. The compression spring 26 operates between an arcuate shaped head 31 positioned in a similarly shaped opening 30 in handle 11 and the dome shaped head 31A of part 29 of rod 27 to normally yieldingly hold surface 23 of link 24 against cam surface 22 in the firing position of the gun. The link is tripped from its firing position by gas pressure from the gun barrel when the gun is fired.

Figures 2, 3, 4:
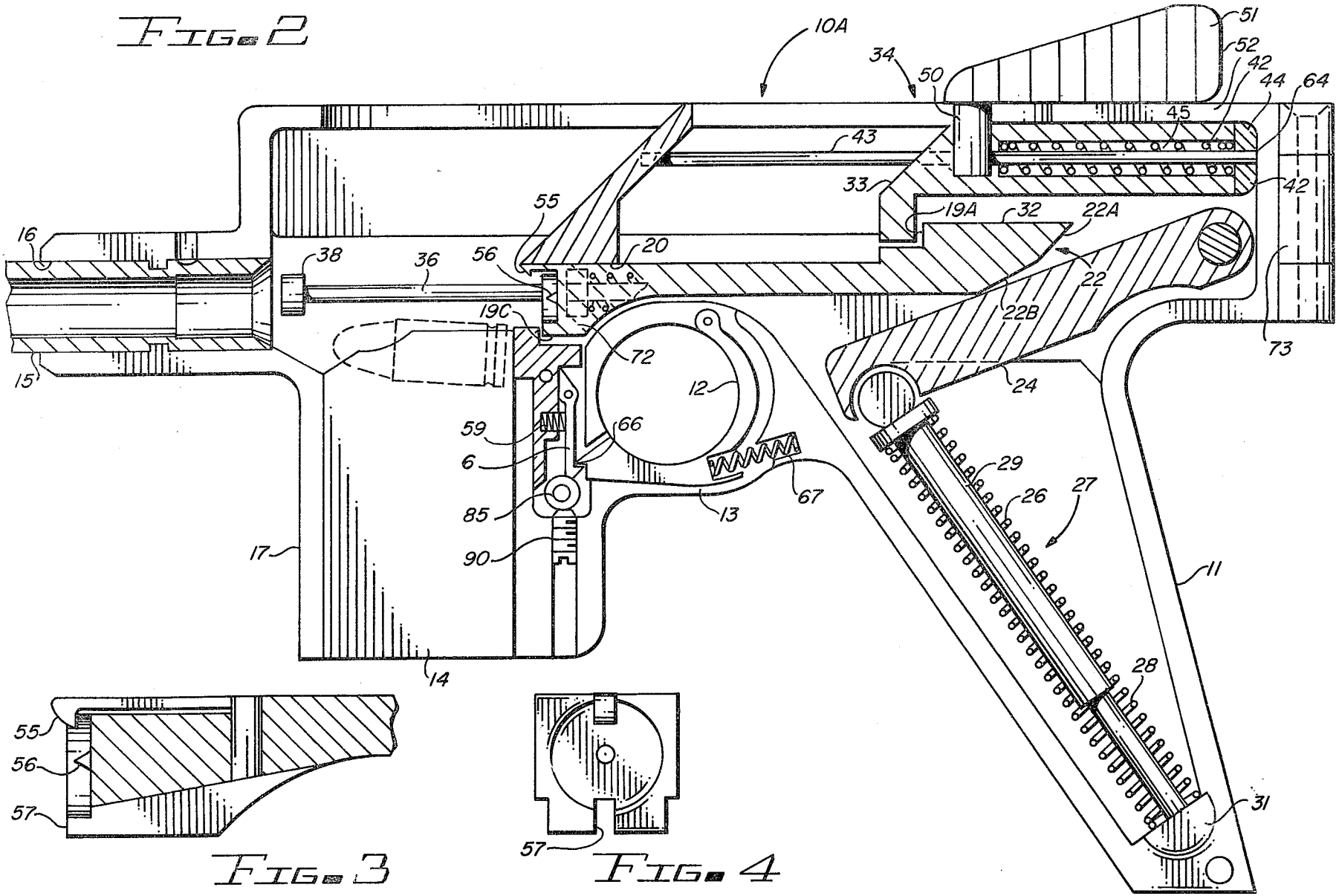
FIG. 2 is a partial cross-sectional view of the link and bolt prior to a gun firing operation.
FIG. 3 is an enlarged partial view of the shell engaging end of the bolt.
FIG. 4 is a left end view of FIG. 3.
Figure 16:
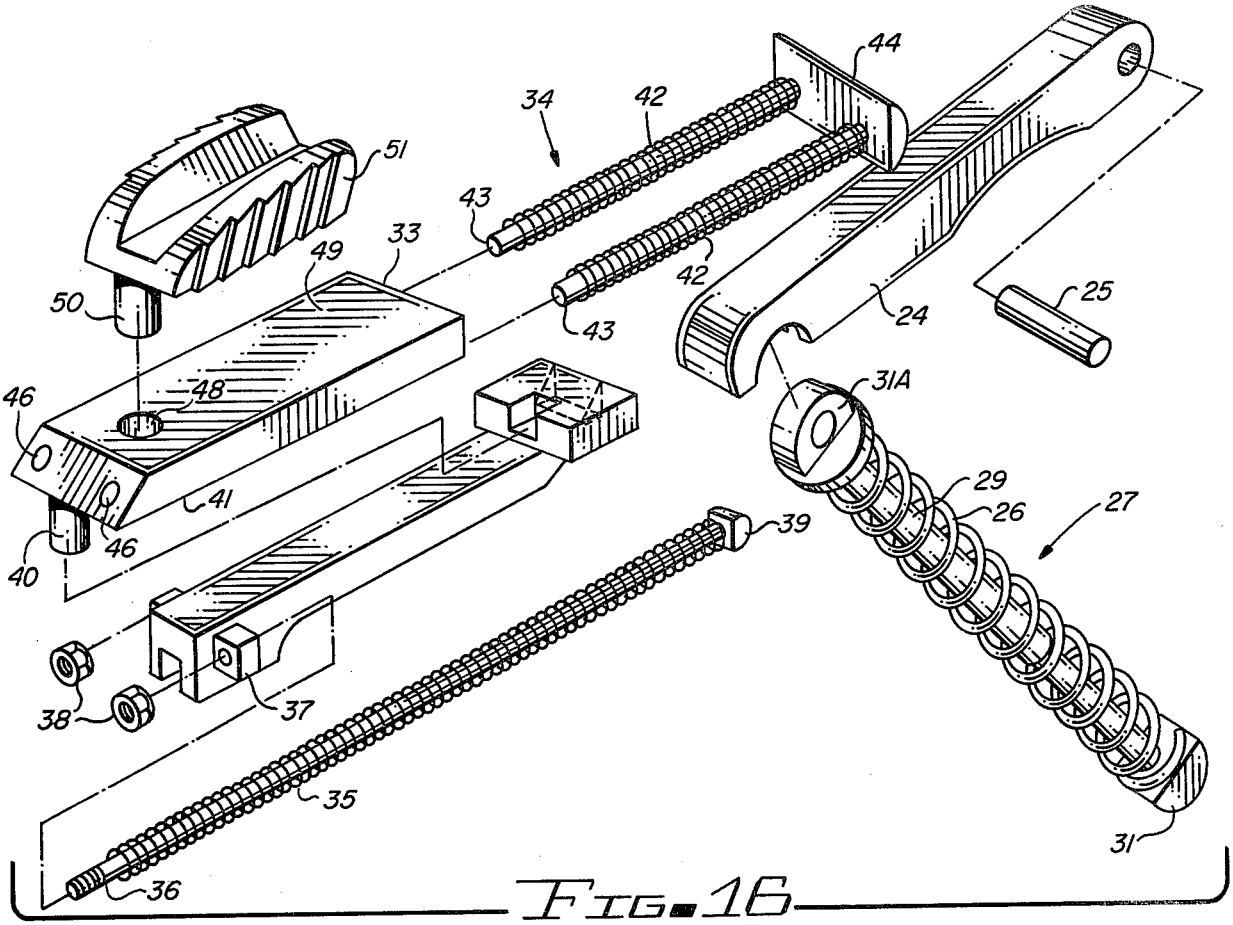
FIG. 16 is an exploded perspective view of the bolt mechanism.

As noted from FIGS. 1, 2 and 16 of the drawings, bolt 19 has been modified to differ from the prior art configurations by providing an elongated bolt configuration with a flat surface on its top which is guided by surface 20 forming a part of the inside periphery of frame 10 of the weapon and a slotted opening 19A extending longitudinally of its upper surface 32 for engaging with a cocking bolt 33, a part of the bolt extraction assembly 34.

As noted from FIGS. 1, 2 and 16, the bolt extraction assembly 34 comprises the elongated bolt 19 biased by a pair of bolt return springs 35 (only one of which is shown), each of which are mounted on a shaft 36, one end of which extends through a flange 37 mounted on each side of bolt 19, as shown in FIG. 16, and secured thereto by nuts 38 threadedly connected thereto. These springs are retained between flanges 37 and a head 39 formed at the opposite free ends of shafts 36.

The cocking bolt 33 comprises an elongated rectangular member having a cylindrical protrusion 40 extending laterally from the bottom surface 41 thereof, as shown in FIGS. 1, 2 and 16, which protrudes into the slot or opening 19A in bolt 19. The bottom surface 41 of the cocking bolt 33 rests on surface 32 of bolt 19. This cocking bolt is further provided with a pair of parallelly arranged compression springs 42, each of which are mounted around a shaft 43, which shafts 43 are secured in a side by side arrangement by a bite member 44. Shafts 43 and their springs 42 each extend into a suitable longitudinally extending opening 45 in cocking bolt 33 with shafts 43 only extending longitudinally through opening 46 in the left end of the cocking bolt 33 to bear against a part of frame 10, as shown in FIG. 1. As noted from FIGS. 1 and 2, the left ends of springs 42 bear against the inside surface of opening 45 with their opposite ends bearing against bite 44 of the spring mounting.

As shown more clearly in FIG. 16, the cocking bolt 33 is provided with an opening 48 extending substantially perpendicularly to its surface 49 inwardly thereof for receiving therein a cooperating shaft 50 of a cocking lever 51. The cocking lever 51 comprising an elongated trough like member is arranged to rest on the top of frame 10 of the hand weapon with its shaft 50 when engaged in opening 48 of cocking bolt 33 moving longitudinally of the frame in slotted opening 52 in the frame. This movement of the cocking lever longitudinally of the frame simultaneously moves the cocking bolt 33 in a common direction against the bias of springs 42 on shafts 43 and springs 35 on shafts 36.

As noted from FIGS. 1 and 2 of the drawings, the bullet striking end of bolt 19 is conformed in a special way to not only engage the bullet with its striking pin, but is provided with a cylindrical indentation 54 to receive therein the end of the shell of bullet 18. A finger 55 extending outwardly of the bullet striking end of bolt 19 is used for extracting the empty shell of the bullet after firing. A striking pin 56 is formed in the center of indentation 54 and axially aligned with barrel 15 for striking the primer of the bullet in the usual manner. As noted from FIGS. 3 and 4, the firing end of bolt 19 is provided with a slot 57 extending longitudinally of its length for receiving a projecting flange 58 of a trip ejector pivotally mounted arm 59.

Arm 59 is pivotally mounted to extend along the length of the guide sleeve 17 for the bullet magazine 14 and is so mounted that its projecting flange 59 will slide in slot 52 of bolt 19 during a part of its travel in frame 10.

It should be noted that the left end of bolt 19 in the cocked position of the weapon, as shown in FIG. 2, engages the projecting flange 58 of the trip ejector arm 59. When the ejector arm 59 is pivoted a predetermined distance by trigger 12 upon firing the weapon, the ejector arm disengages with bolt 19 and the bolt moves toward the barrel, picking up a bullet from magazine 14 and driving it into the barrel.

During a firing operation of the weapon, bolt 19 moves to the right, as shown in FIGS. 1 and 2, with finger 55 formed at the left end of bolt 19 engaging the known groove in the base of the shell forming a part of bullet 18 and pulling the spent shell out of the barrel and along with it. At the point when bolt 19, and particularly the periphery of slot 57, engages projecting flange 58 of ejection arm 59, the finger 55 of the bolt in combination with the momentary resistance provided by projection 58 of rejection arm 59 causes a sharp clockwise movement of the shell causing it to be projected out of a port 60 in the frame 10 of the weapon. After this momentary engagement of bolt 19 with projection 58 of ejection arm 59, the ejection arm pivots clockwise a small distance disengaging the projection from the walls of slot 57 permitting the bolt to be fully retracted under the force of the explosion.

At the time the bullet is fired and leaves the barrel and is on its way to its target, residual pressure existing in a chamber of this weapon will drive its bolt 19 backwards with sufficient force to complete the travel of its linkage mechanism sufficiently to move the free end of link 24 and force it to complete its downward travel to its lowest point down inside the handle of the gun against the bias of its compression spring shown in FIG. 2.

As disclosed herein, bolt 19 moves in conjunction with the cocking bolt 33. The cocking bolt mechanism comprises a pair of springs 42 each seated in bores 63 formed in the back end of the frame of the weapon and extend to the front end of the frame in its hollow interior.

The inertia of the rearward action of the bolt compresses the recoil compression spring 42 as well as spring 35 after the edge of flange 37 of bolt 19 engages projection 58 of the ejection arm 59 and continues then to compress all three springs until the end of the cocking arm 33 engages a stop surface 64 of the frame of the weapon. When bolt 19 is moved rearwardly in the frame of the weapon, its cam surface 22 slides over the top surface 23 of link 24 pushing it downwardly under the biasing effect of its spring 26. The bolt and toggle are then returned to their original positions by the stored up energy in springs 42 and 35 with the locking portion 65 of cam surface 22 of the bolt 19 engaging and being held in locked position by surface 24B of link 24. This completes the firing cycle and prepares the gun for the second firing having picked up an additional bullet from the clip magazine and placed it in the chamber when the bolt returned to its original position by a well known conventional mechanism.

In order to trip link 24 to lead the first bullet into the gun, the cocking lever 51, as shown in FIGS. 1 and 2, is provided on the gun which when pulled back on by the operator, causes it to trip or move link 24 downwardly enough to allow the operator to move bolt 19 backwardly sufficiently to permit a bullet 18 from the clip magazine 14 to enter the chamber of the gun for the first firing action.

This manual lever 51 extends laterally from the cocking bolt 33 of the weapon outwardly of frame 10 in the longitudinal extending slot 52 of frame 10 of the weapon or gun.

Figure 9:
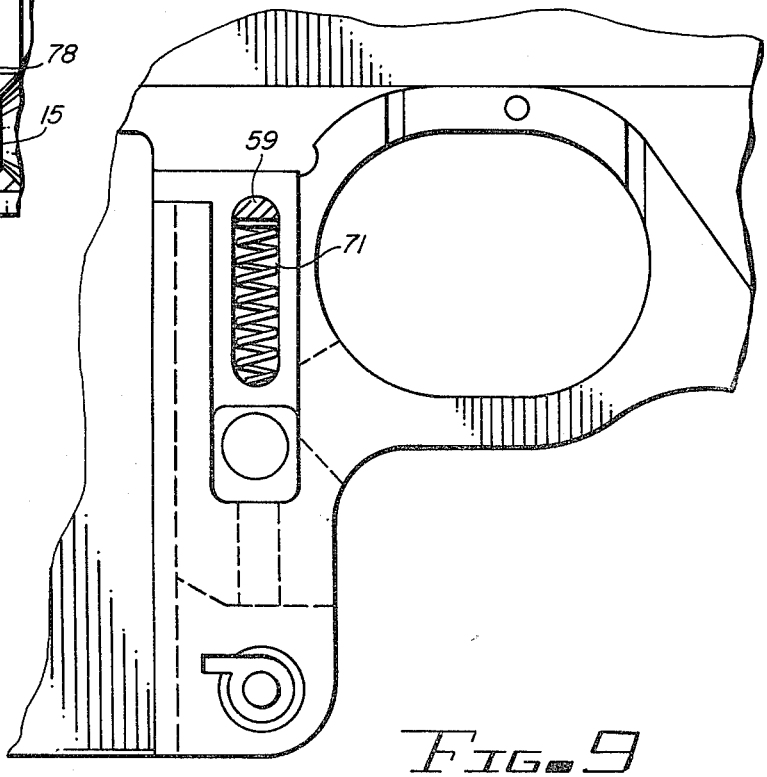
FIG. 9 is an enlarged view of the trigger mechanism shown in FIG. 1 illustrating the trip ejector, tab and spring.

When the weapon is fired by applying rearward pressure on trigger 12, a nose 66 thereof which is biased outwardly thereof by a spring 67 a predetermined distance, causes its nose 66 to extend outwardly thereof into engagement with a catch 68 on a pivotally mounted sear 69 housed in an opening 70 of frame 10 adjacent bullet magazine 14. This action moves trip ejector arm 59 downwardly against the biasing action of a spring 71, as shown in FIG. 9, away from surface 19C of bolt 19, as shown in FIG. 2, releasing bolt 19 which causes bolt 19 and cocking bolt 33 to move forward under the action of springs 35 and 42 to fire the weapon. When bolt 19 moves forward, it drives pin 56 of bolt 19 into engagement with the firing end of bullet 18. Engagement of pin 56 with the bullet causes it to explode in the usual manner. After pin 56 engages and fires bullet 18, the force of the explosion drives bolt 19 backwardly toward the handle of the weapon. This reverse movement of the bolt compresses springs 35, 42 and 26 to absorb the reactive forces of the exploding bullet. During the backward or reverse movement of bolt 19, the lower or striker surface 72 of bolt 19 moves over the surface of the ejector arm 59 driving it downwardly against its spring 71 and cam rider 22 of bolt 19 moves over cam surface 23 of link 24.

As evident from FIGS. 1 and 2, as bolt 19 moves backwardly in frame 10 under the explosive forces of the bullet toward the rear end thereof, cam rider 22 moves over cam surface 23 of link 24 forcing the free end of link 24 to move into handle 11 of the weapon compressing spring 26.

The cam surface 23 of link 24 is conformed to provide a predetermined time delay of the movement of the cam rider or surface 22 therealong before the end of the cocking bolt 33 reaches the bite 44 and the stop surface 64 of frame 10.

As shown in FIG. 2, the cam surface 22 of bolt 19 has two different angularly arranged portions 22A and 22B. Portion 22B is arranged to aid the bolt in moving over the cam surface 23 of link 24 while portion 22A is provided to aid in holding and locking the weapon in its at rest position.

Heretofore, springs placed in the weapon to bias the toggle into its extended position had difficulty in placing the toggle and the bullet in the magazine in an identical position each time the weapon was fired. If a spring was positioned in the gun so as to be longitudinally arranged with the bolt of the weapon, the spring was then capable of driving the bullet forward into the chamber of the gun hard enough to seat it properly but it was not in a favorable position for absorbing recoil of the weapon or to aid in positioning the toggle in its properly extended position each and every cycle of gun actuation. Thus, if only a single spring was used longitudinally of the toggle mechanism, the toggle whether it was an under-center or over-center mechanism usually sagged a bit and if there was any friction in the operation of the moving parts, the sag prevented the bullet from being seated identically in the same position each time. Springs mounted to operate on the knee of the toggle arranged transversely to the longitudinal axis of the toggle failed also to seat the bullet each and every time and particularly were not in the most favorable position for absorbing recoil of the exploding shell.

Therefore, it is necessary to modify the bolt as disclosed hereto to operate in conjunction and combination with link 24 to obtain a dynamic balance operating system to absorb the recoil of the exploding shell as well as control the operation of the collapsing and extending action of the link mechanism.

As noted from the drawings, bolt 19 is free to move under the action of springs 35 and 42. It has no mechanical connection to the tripping mechanism comprising link 24 and its controlling mechanism. After a firing sequence and return of bolt 19 to its forward position in the frame of the weapon, spring 26 moves and maintains link 24 and its surface at the free end of the link against cam rider 22 to hold and/or lock the bolt in its extended, i.e., at rest position.

Thus, the prior art drag on the bolt has been eliminated by the disclosed design.

Figure 7:
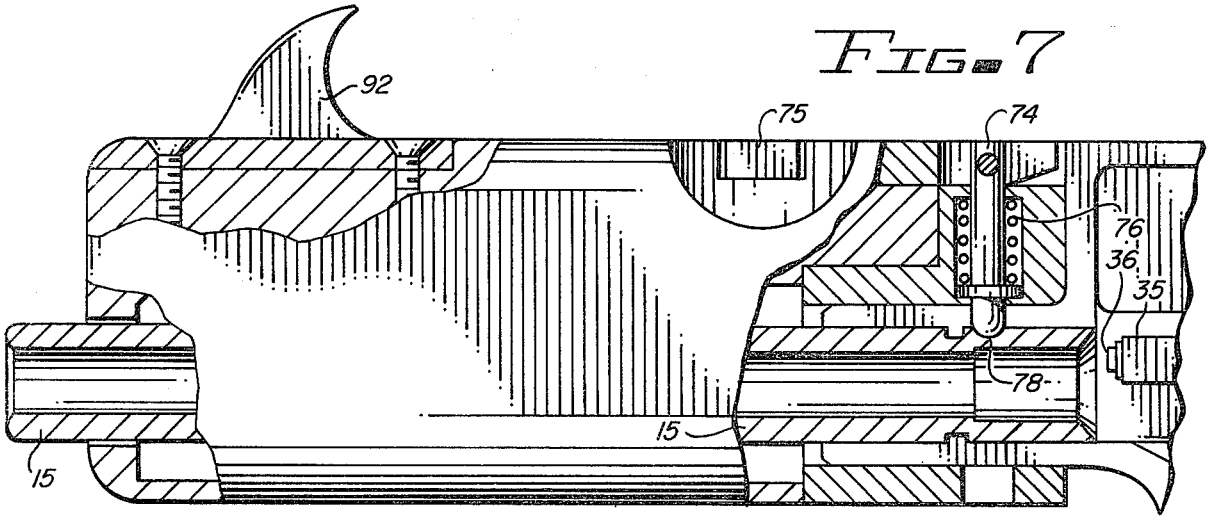
FIG. 7 is a view partially in cross-section of the left end of the weapon, missing in FIG. 1, with the barrel locked in place.
Figure 8:
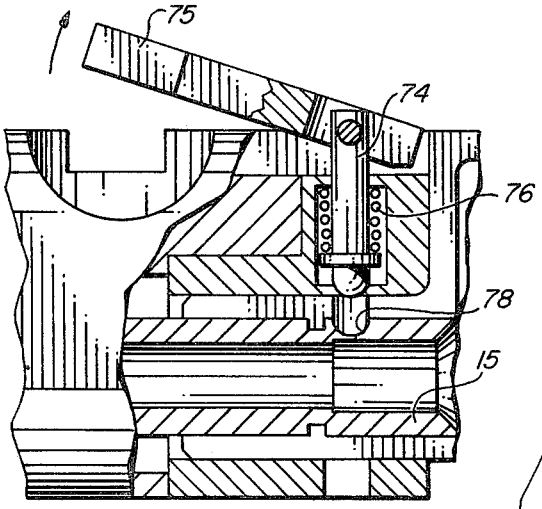
FIG. 8 is a partial cross-sectional view of the structure shown in FIG. 1 with the barrel released for removal from the weapon.

As shown in FIGS. 1, 2, 5 and 6, frame 10 comprises two substantially identical parts 10A and 10B which are pivotally connected together by a frame bolt 73. When the frame parts 10A and 10B are juxtapositioned, barrel 15 is interlocked therebetween by a barrel locking pin 74 and retaining release lever 75 shown more clearly in FIGS. 7 and 8. As shown, barrel release lever 75 is pivotally attached to the stem of the locking pin 74 and when pivotally moved away from the barrel (as shown in FIG. 8), compresses coil spring 76 mounted around pin 74 and withdraws a sphere shaped end 77 of pin 74 from a detent 78 in the shell receiving end of the barrel. The barrel then can be readily removed from frame 10.

FIGS. 10–11 disclose the details of the latching mechanism 80 for receiving and releasing magazine 14 from guide sleeve 17. As shown, the release mechanism 80 comprises a spring biased pivotally mounted lever arm 81 which, as shown in its locked position in full lines in FIG. 10, has a nose portion 82 thereof protruding into an opening 83 in the rear edge of the magazine 14 forming an interference fit therewith and locking the magazine in guide sleeve 17. When the lever arm 81 is pivoted to its release position against the biasing action of its spring 84, nose portion 82 of lever arm 81 moves out of opening 83 in the magazine and the magazine may be pulled out of sleeve 17 in the usual manner.

FIGS. 12–14 disclose a safety catch comprising a bolt 85 which is provided with two cylindrical ends 86 and 87 which are journalled in bearing openings 88 (shown in FIG. 5), one formed in each of the frame portions 10A and 10B for movement laterally of the frame from a weapon locked position to a weapon fireable position.

The center portion of bolt 85 is provided with a grooved rectangular portion 89 formed out of one half of the cylindrical bolt configuration. When positioned in the weapon, the bolt 85 is arranged as shown in FIG. 14 with set pin 90 protruding into groove 91 formed between ends 86 and 87 of the bolt and holding the bolt in frame 10 but permitting lateral movement of the bolt a distance equal to the length of groove 89.

As noted from FIGS. 12–14, the opposite side of the center portion of bolt 85 from that forming groove 89 is provided with two grooves 91 extending laterally thereacross. These grooves are provided for receiving the free ends of trip ejector arm 59 and sear 69 when the safety catch is moved to the firing position of the weapon. When the bolt 85 is moved to the weapon locking position of the weapon, the grooves 91 in bolt 85 will be moved away from the free ends of trip ejector arm 59 and sear 69 thereby causing an interference between an edge of the center section of bolt 85 and the free ends of the ejector arm and the sear thereby prohibiting a movement of trigger 12.

FIG. 15 discloses the forward or front sight 92 of the weapon which is mounted on the free end of barrel 15.

Figure 17:
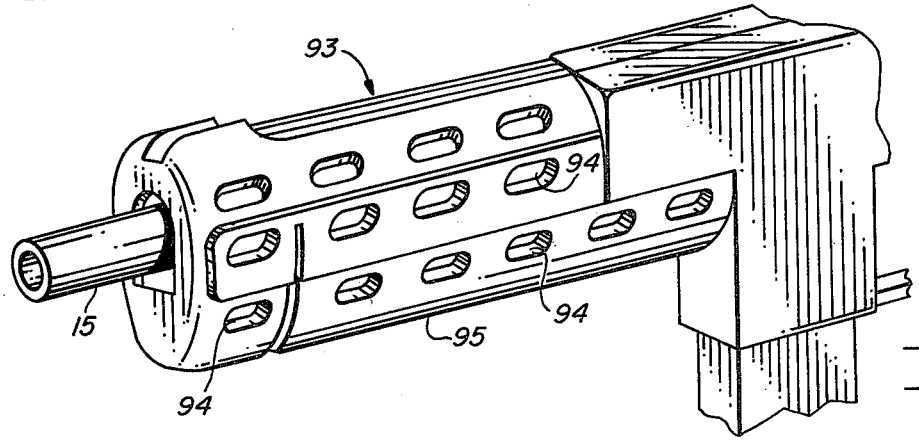
FIG. 17 is a perspective view of another casing of the weapon shown in FIG. 1.
Figure 17A:
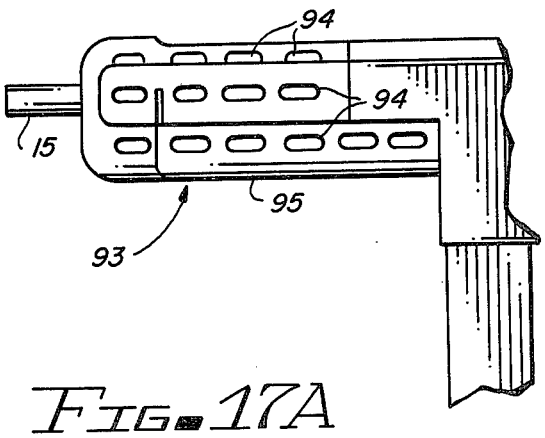
FIG. 17A is a side view of FIG. 17.
Figure 17B:
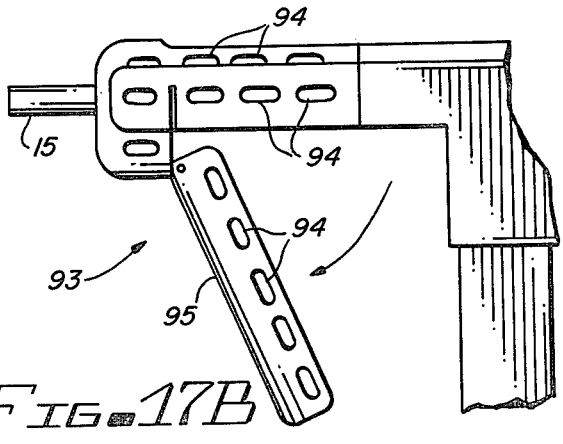
FIG. 17B is a side view of FIG. 17 with a part of the housing pivotally disengaged.

FIGS. 17, 17A and 17B disclose another casing 93 for the weapon and particularly the barrel end thereof. This casing employs a plurality of apertures 94 extending therethrough arranged along the barrel 15 for cooling purposes. A portion 95 is pivotally hinged to the remaining portion for assembly purposes.

Although but one embodiment of this invention has been illustrated and described, it will be apparent to those skilled in the art that various changes and modifications may be made therein without departing from the spirit of the invention or from the scope of the appended claims.

I claim:

1. A bolt action weapon comprising:

a frame, a handle on said frame, a trigger mounted on said frame adjacent said handle, a hollow barrel having a firing chamber, a bolt movable in said frame axially to and from the firing chamber of said barrel, said bolt being provided with a surface at one end thereof which is angular to the longitudinal axis of said bolt forming a first cam surface, an elongated link connected at one end to said frame and providing a second cam surface along its length for engagement with said first cam surface, said first cam surface of said bolt and said second cam surface of said link being relatively slidably movable one over the other until said second cam surface engages a particular area on said first cam surface to retain said bolt when it has been moved to said firing chamber, a compression means mounted in said handle for biasing said link into contact with said bolt and for controlling the movement of said link as it collapses by causing its free end to swing downwardly away from said bolt into said handle, and a trip ejector arm pivotally mounted on said frame adjacent said trigger for restraining the bolt from moving to said firing chamber until actuated for pivotal movement by said trigger.

2. The bolt action weapon set forth in claim 1 wherein:

another end of said bolt is provided with an indentation for picking up a bullet from a magazine attached to said frame and placing it in said firing chamber, said indentation being circular in form and larger than the diameter of the shell end of the bullet.

3. The bolt action weapon set forth in claim 2 wherein:

said another end of said bolt is provided with a flange for engaging the periphery of the shell of the bullet, said bolt when retracted from adjacent the firing chamber of the barrel under the explosive force of the bullet holding with said flange the shell of the bullet until the bolt engages said ejector arm at which time the shell of the bullet is pivoted out of the weapon.

4. The bolt action weapon set forth in claim 3 wherein:

said flange comprises a finger like structure protruding from said another end of said bolt for engaging an indentation in the shell of the bullet.

5. The bolt action weapon set forth in claim 2 wherein:

said another end of the bolt is slotted longitudinally thereof for receiving in said slot and passing therethrough the end of said ejector arm after it has momentarily restrained said bolt.

* * * * *